United States Patent [19]

Lin et al.

[11] 4,069,047

[45] Jan. 17, 1978

[54] TRANSFER OF PHOTOELECTROPHORETIC IMAGES

[75] Inventors: Luke C. Lin, Rochester; Morton Schrager, Fairport, both of N.Y.

[73] Assignee: Xerox Corporation, Stamford, Conn.

[21] Appl. No.: 591,182

[22] Filed: June 27, 1975

[51] Int. Cl.[2] ..... G03Q 13/24

[52] U.S. Cl. ..... 96/1.4; 96/1.3; 96/28

[58] Field of Search ..... 96/1 PE, 1 M, 1 PS, 96/1.3, 1.4, 28

[56] References Cited

U.S. PATENT DOCUMENTS

| | | | |
|---|---|---|---|
| 2,855,324 | 10/1958 | Van Dorn | 96/1.4 X |
| 3,060,024 | 10/1962 | Burg et al. | 96/28 |
| 3,549,447 | 12/1970 | Bresnick | 96/1.4 X |
| 3,705,797 | 12/1972 | Mihaslov et al. | 96/1 PE |
| 3,737,311 | 6/1973 | Wells | 96/1.3 X |
| 3,791,822 | 2/1974 | Goffe | 96/1 PS |
| 3,820,987 | 1/1974 | Wells et al. | 96/1 PE X |
| 3,836,364 | 9/1974 | Lin | 96/1.4 |
| 3,847,642 | 11/1974 | Rhodes | 96/1.4 X |

*Primary Examiner*—Roland E. Martin, Jr.
*Attorney, Agent, or Firm*—James J. Ralabate; Eugene O. Palazzo; John E. Crowe

[57] ABSTRACT

There is disclosed a photoelectrophoretic imaging system wherein a layer of an imaging suspension is arranged between a conductive transparent electrode and a second electrode, preferably a blocking electrode, subjected to an electrical field and exposed to an imagewise pattern of activating electromagnetic radiation to form an image on the transparent electrode which is subsequently transferred to a receiver member and fixed thereto. The conductive transparent electrode comprises a layer of a conductive material overlying a layer of polymeric material which overlies a substrate and is also utilized during the transfer and fixing of the image.

14 Claims, 2 Drawing Figures

TRANSFER OF PHOTOELECTROPHORETIC IMAGES

BACKGROUND OF THE INVENTION

This invention relates to photoelectrophoretic imaging and more specifically to a photoelectrophoretic imaging system which includes a conductive transparent electrode.

In general, a photoelectrophoretic imaging system is one wherein electrically photosensitive pigment particles dispersed in a carrier liquid are exposed to an imagewise pattern of activating electromagnetic radiation and subjected to an electrical field. Photoelectrophoretic imaging may be practiced in monochromatic and polychromatic modes. A detailed description of monochromatic and polychromatic photoelectrophoretic imaging systems is found in U.S. Pat. Nos. 3,383,993; 3,384,488; 3,384,565 and 3,384,566.

In a preferred embodiment a layer of imaging suspension is arranged between a pair of electrodes, one of which is conductive and at least partially transparent and the electrical field is established between the electrodes. Typically, complementary images are formed on the surfaces of the electrodes and these may be fixed thereto or, alternatively and preferably, transferred to a receiver member and fixed thereto. The positive image is that of primary interest and it is preferably formed on the conductive electrodes.

Various methods for fixing images formed electrophotographically and photoelectrophoretically are known in the art. For example, U.S. Pat. No. 3,814,267 discloses a fixing member comprising a substrate, and a thermoplastic resin layer sandwiched around an intermediate layer that controls the adhesiveness between the substrate and the thermoplastic layer. In operation the member is applied over the image bearing member and by applying heat and/or pressure the thermoplastic layer is caused to be adhered over the image bearing surface. U.S. Pat. No. 3,705,797 discloses a technique for fixing photoelectrophoretically formed images with a thermoadhesive layer which when in a softened state, will cause the image to be embedded in the layer and permanently held therein when the layer is permitted to reharden. U.S. Pat. No. 3,791,823 discloses employing a water tackifiable surface to fix images formed photoelectrophoretically.

SUMMARY OF THE INVENTION

It is an object of this invention to provide a novel photoelectrophoretic imaging system.

It is another object of the invention to provide a system wherein one electrode is transparent and conductive.

It is a further object to provide a system wherein the transparent conductive electrode is used for also transferring and fixing an image formed thereon.

Still another object of the invention is to provide a transparent conductive electrode comprising a conductive layer overlying a layer of polymeric material which overlies a substrate.

BRIEF SUMMARY OF THE INVENTION

These and other objects and advantages are accomplished according to the invention by providing a photoelectrophoretic imaging system wherein a layer of an imaging suspension is arranged between a conductive transparent electrode and a second electrode, preferably a blocking electrode, subjected to an electrical field and exposed to an imagewise pattern of activating electromagnetic radiation to form an image on the transparent electrode which is subsequently transferred to a receiver member and fixed thereto. The conductive transparent electrode comprises a layer of a conductive material overlying a layer of polymeric material which overlies a substrate. In operation the transparent electrode carrying the image is brought into contact with an image receiving member and heat is applied so as to cause at least some portion of the polymeric interlayer to be released from the substrate and accompany the image to the image receiving member. The substrate is stripped away and the conductive layer and the polymeric interlayer material form a laminate over the image on the image receiving member.

It should be noted here that the term "transparent", as used to describe the transparent conductive electrode utilized according to the invention, is meant to include electrodes which are substantially completely transparent and those which are only partially transparent yet will transmit enough radiation to allow imaging to occur.

BRIEF DESCRIPTION OF THE DRAWINGS

For a better understanding of the invention as well as other objects and further features thereof, reference is made to the following detailed description of various preferred embodiments thereof, taken in conjunction with the accompanying drawings wherein.

DESCRIPTION OF THE PREFERRED EMBODIMENTS

Figure 1:
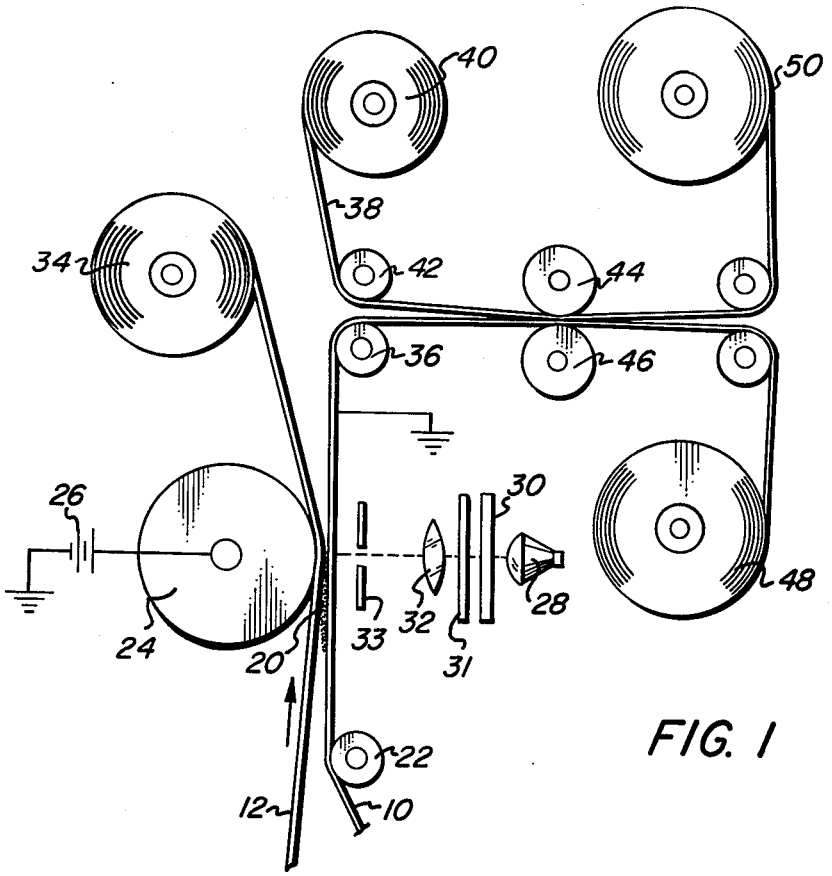
FIG. 1 is a partially schematic cross-sectional view of a photoelectrophoretic imaging system according to the invention.

In FIG. 1 there is illustrated a photoelectrophoretic imaging system according to the invention wherein a pair of traveling webs 10 and 12 comprise a pair of electrodes. Electrode 10 is a transparent conductive electrode and will be referred to hereinafter as the "injecting electrode." When used throughout this application the term "injecting electrode" should be understood to mean an electrode which will preferably be capable of exchanging charge with the photosensitive particles of the imaging suspension when the suspension is exposed to activating radiation so as to allow for a net change in the charge polarity of the activated particles. Electrode 10 in the present system is preferably flexible and as shown more in detail in FIG. 2, comprises a substrate 14, a layer of polymeric material 16 and a layer of conductive material 18. Substrate 14 serves primarily as a support for the other layers of the member and may comprise any suitable material having the requisite optical and mechanical properties. Generally, substrate 14 should be optically clear, e.g., have a light transmission of at least about 20%, and may be of any thickness capable of withstanding the stress applied during imaging, typically about 1 mil. The substrate may be electrically insulating or conductive; in the latter instance the layer would have to be grounded during imaging. It is preferred to use electrically insulating polymeric materials as the substrate since there are readily available many such materials having the requisite optical and mechanical properties. Typical suitable substrate materials include polypropylene, polycarbonates, and polyesters.

Layer 16 may comprise any of many polymeric materials such as, for example, low molecular weight (about 3,000–5,000) polystyrene, acrylics, polyesters and the like. The material should be clear, e.g., have a light transmission of at least about 20% and should be selected such that the adhesive and surface forces thereof will allow at least a portion of the layer to be easily releasable from the substrate during the transfer operation. Since the interlayer material eventually will form a protective surface over the image after it is transferred to the image receiving member, layer 16 should preferably possess the properties generally associated with materials used for lamination over photographs such as minimal tackiness. It should also be noted that additives may be incorporated in layer 16 for various reasons. For example, filler materials such as Cab-O-Sil (a colloidal silica available from Cabot Corp.) and titanium dioxide or plasticizers may be incorporated in the layer to modify its cohesive and surface forces. Also, additives may be used in order to obtain desired characteristics for the final image such as where it is desired to provide a matte finish over the image. The melting point, or the glass transition temperature of the material comprising layer 16 may be higher or lower than that of the substrate material.

Conductive layer 18 may comprise any suitable transparent conductive material and preferably should be a material which will adhere well to the image receiving member. Typical suitable transparent conductive layers include continuously conductive coatings of conductors such as tin, indium oxide, aluminum, chromium, tin oxide or the like; conductive organic film forming materials which are cationic such as polymeric quaternary ammonium salts or those which are anionic such as salts of polystyrene sulfonic acid. A particularly preferred conductive layer comprises purified polystyrene sulfonic acid (PSSA) which preferably also includes about 5% by weight of Cab-O-Sil. It is preferred to incorporate Cab-O-Sil or a similar material in the PSSA layer to prevent it from blocking or sticking when the electrode material is wound into a roll. Electrode 10 can be made by coating techniques well known to those skilled in the art.

It should be noted here that an injecting electrode could be made up of a layer of PSSA including an anti-sticking additive such as Cab-O-Sil on a substrate such as polypropylene. An injecting electrode of this type can be used in the photoelectrophoretic imaging mode and provide highly satisfactory performance.

Coated on the surface of electrode 10 is a layer of an imaging suspension 20 which comprises finely divided electrically photosensitive pigment particles dispersed in a carrier liquid. The term "electrically photosensitive" as applied to the imaging particles dispersed in the carrier liquid, is intended to encompass any particle which, once attracted to the injecting electrode, will migrate away from it under the influence of an electrical field when the particle is exposed to activating electromagnetic radiation. For a detailed description of the apparent mechanism of operation of photoelectrophoretic imaging see U.S. Pat. Nos. 3,384,565 and 3,384,566. The imaging suspension may comprise any suitable electrically photosensitive particles dispersed in a carrier liquid and may include one type of particle or a plurality of differently colored particles in finely divided powder form. The suspension may be employed in either the monochromatic or polychromatic modes. Any suitable electrically photosensitive pigment particles may be used according to the invention including for example, the types disclosed in U.S. Pat. Nos. 2,980,847 and 3,681,064. An extensive list of typical suitable electrically photosensitive pigment particles is provided in U.S. Pat. No. 3,384,488 and other prior art patents. Accordingly, an extensive discussion of electrically photosensitive pigment materials is not required here. Imaging suspension layer 20 typically has a thickness of up to about 50 microns and preferably about 25 microns and may be deposited on the surface of electrode 10 by any suitable technique. In a preferred embodiment layer 20 may be deposited electrophoretically such as is disclosed in U.S. Pat. No. 3,620,948 by means of a biased roller or some other suitable biased member. In another preferred embodiment the imaging suspension layer may be subjected to an electrostatic charge such as by applying charge from corona charging means prior to imaging as is disclosed in U.S. Pat. No. 3,477,934. As will be described more in detail hereinafter, the image of primary interest is that formed on the injecting electrode 10. Accordingly, these techniques are preferred, inter alia, because all or substantially all of the imaging particles are caused to deposit on the injecting electrode surface and thus are available to take part in the formation of the image of primary interest.

Any suitable electrically insulating liquid may be used as the carrier liquid in the imaging suspension. Typical insulating carrier liquids include: long chain saturated aliphatic hydrocarbons such as decane, dodecane, and tetradecane; kerosene fractions, such as Sohio Odorless solvents available from the Standard Oil Company of Ohio, Isopar G commercially available from the Humble Oil Company of New Jersey; molten thermoplastic materials such as paraffin wax and bee's wax; mineral oil; vegetable oils such as linseed oil and olive oil; silicone oils such as dimethylpolysiloxane (Dow Corning Company); fluorinated hydrocarbons such as Freon; and mixtures thereof. The imaging suspension may also contain a sensitizer and/or binder.

Electrode 12 in the present system is preferably a blocking electrode. By the term "blocking electrode" is meant one which is substantially incapable of injecting charge carriers into the electrically photosensitive particles as compared to the injecting electrode thus substantially blocking direct current. The use of a blocking electrode serves to minimize particle oscillation in the system and to prevent electrical shorting between the electrodes which might otherwise occur. Hence, although a blocking electrode is not required in the system, the use of such an electrode is preferred because of the markedly improved results which it is capable of providing. The blocking electrode typically comprises a layer of an insulating material or a semiconductive material. Generally, any material having a resistivity at least about $10^7$ ohm-cm may be used. Typical suitable materials include polystyrene, polytetrafluoroethylene, baryta paper, polyurethane and the like. Preferred materials include Tedlar, Mylar and polypropylene. As illustrated, blocking electrode 12 comprises a layer of a material such as polypropylene. Of course, there are known many electrode configurations for use in photoelectrophoretic imaging. In systems wherein the blocking electrode is provided in a roller configuration, the electrode typically comprises a relatively highly conductive core with a layer of blocking material forming the outer surface of the roller or if a material having relatively low conductivity is used for the core, a separate electrical connection may be made to the back of the blocking electrode. For example, the blocking layer, or sleeve may be a material such as Tedlar and if a hard rubber nonconductive core is used then a metal foil such as aluminum is employed as the backing for the Tedlar layer.

Although the invention is illustrated with respect to a system wherein exposure is made through the injecting electrode 10 it should be noted that exposure may also be effected through the blocking electrode or, in other systems, the suspension need not be exposed through either of the electrodes. For example, U.S. Pat. No. 3,647,659 discloses that the electrical field may be applied across the suspension layer after exposure has been carried out and terminated when the imaging suspension layer is electrophoretically deposited prior to exposure. As noted previously, where exposure is made through one of the electrodes, it should be noted that the electrode need not be completely transparent to the activating radiation but rather it may be only partially transparent; the only requirement is that the electrode transmit enough radiation to cause imaging to occur. It should also be understood that the present photoelectrophoretic imaging system may be practiced with either or both electrodes in the form of drums, rollers, flat platens, etc.

In operation, injecting electrode 10 carrying imaging suspension layer 20 is advanced into the imaging zone by roller 22. At the entrance to the imaging zone blocking electrode 12 is brought into contact with the free surface of suspension layer 20 and is also maintained in contact with a biased roller 24. An electrical field is established across the suspension layer by applying a potential from source 26 to roller 24 with the conductive layer 18 of injecting electrode 10 connected to ground at some suitable location in the system. Any of many techniques known to those skilled in the art may be utilized to ground conductive layer 18. The suspension layer is exposed to an imagewise pattern of activating electromagnetic radiation by means of a projection mechanism comprising in this illustrative instance a light source 28, color transparency 30, optional color correction filter 31, lens 32 and scanning slit 33. It is noted that scanning slit 33 moves in a direction opposite to that of the electrodes during imaging. Transparency 30 is preferably a color positive transparency and the image formed on the injecting electrode is preferably positive in image sense. As electrodes 10 and 12 exit from the imaging zone they are separated and there are formed complementary images on the surfaces of the electrodes.

As noted previously, it is preferred to form a positive image on the injecting electrode since, according to the present invention, the image formed on that electrode is of primary interest. Of course, the image formed on the blocking electrode is also useful. Blocking electrode 12 is wound around a takeup roller 34. The injecting electrode carrying the positive image advances by guide roller 36 and is brought into contact with a layer of receiver material 38. Layer 38 may comprise any suitable image receiving material and is preferably paper. The receiver material can be provided in the form of a roll 40, as illustrated and is guided into contact with the image bearing surface of the injecting electrode by roller 42. The respective members are then passed through a pair of heated rollers 44 and 46 in order to cause at least a portion of polymeric layer 16 of electrode 10 to release from the substrate 14 and accompanying the image to the image receiving member. Of course, any other suitable technique for heating the polymeric layer 16 may be used.

Figure 2:
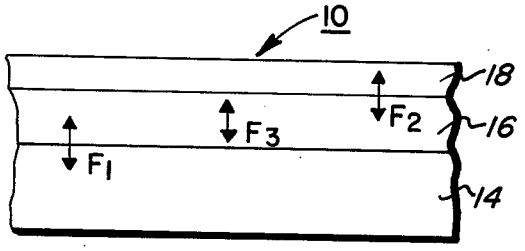
FIG. 2 is a schematic cross-sectional view, greatly enlarged, of a conductive transparent electrode according to the invention.

It should be noted that only a portion, or substantially all, of polymeric layer 16 may be released from the substrate 14 during the transfer step. The particular embodiment which occurs in any instance is dependent primarily upon the cohesive and surface forces, under transfer conditions, of the individual layers which comprise the injecting electrode. Referring now to FIG. 2 the arrow designated $F_1$ represents the adhesive force with which the substrate 14 and polymeric layer 16 are held together, the arrow designated $F_2$ represents the adhesive force with which the conductive layer 18 and polymeric layer 16 are held together and the arrow designated $F_3$ represents the cohesive force of polymeric layer 16 itself. Of course, it will be seen that typically $F_2$ should be greater than $F_1$ under the conditions at which transfer occurs since if this were not so the conductive layer 18 would tend to separate from layer 16 at their interface and this is not desirable. Generally, for optimum transfer and fixing of the image according to the invention $F_1$ typically should be greater than $F_3$ or the reverse, under transfer conditions. For example, if $F_1$ were greater than $F_3$ then upon being heated layer 16 would tend to fracture internally during transfer and a portion of the layer would accompany the image to the receiving member and a portion would remain on substrate 14. Where $F_3$ is greater than $F_1$ under transfer conditions such as where layer 16 has a melting point or glass transition temperature higher than that of substrate 14 then substantially all of layer 16 would tend to separate from substrate 14. It should also be noted that where electrode 10 and receiver member 38 are brought into contact a cohesive force will exist between the contact surfaces of receiver member 38 and conductive layer 18. This cohesive force typically should be greater than $F_1$ or $F_3$. During the transfer step pressure is also applied to cause the image to become firmly adhered to the receiving means. Typically, a pressure of about 20 p.s.i. is applied.

In this manner the image is caused to be transferred to the surface of a receiver layer 38 and conductive layer 18 and at least some portion of polymeric layer 16 are laminated over the image. Upon cooling the image is found to be firmly fixed to the receiver member and is protected by a clear overlayer. A significant advantage of the present invention is that the complete image is conveniently transferred to the receiving member thus providing optium use of the image forming pigment materials. The substrate 14 is subsequently split away and wound around takeup roller 48. The receiver member carrying the fixed image can be slit to a desired size or, as illustrated can be stored by winding layer 38 around takeup roller 50 for later use.

As noted previously, the photoelectrophoretic imaging system can be practiced in both the monochromatic and polychromatic modes. For monochromatic imaging pigment particles of only one color are required, however, particles of more than one color may utilized if it is desired to provide the capability to reproduce a range of monochromatic colors. Any desired single color may be obtained in this fashion. For polychromatic imaging, at least two differently colored pigment particles are incorporated in the imaging suspension. The selection depends largely upon the photosensitivity and the spectral sensitivity desired. The particles are selected so that those of different colors respond to different wavelengths in the visible spectrum corresponding to their principal absorption bands. Also, the pigments should be selected so that their spectral response curves do not have substantial overlap, thus allowing for good color separation and subtractive multicolor image formation.

In a typical polychromatic system, the particle suspension may include cyan colored particles which are sensitive mainly to red light, magenta colored particles which are sensitive mainly to green light, and yellow colored particles which are mainly sensitive to blue light. When mixed together in a carrier liquid these particles produce a black-appearing liquid. When one or more of the particles are caused to migrate from injecting electrode 10 toward the second electrode, they leave behind particles which produce a color equivalent to the color of the activating light. Thus, for example, red light exposure causes the cyan colored pigment to migrate leaving behind the magenta and yellow pigments which combine to produce red in the final image. In the same manner, blue and green colors are reproduced by removal of yellow and magenta, respectively. When white light impinges upon the mix, all pigments migrate, leaving no pigmentary color on the electrodes. No exposure leaves behind all pigments which combine to produce a black image. This is an ideal technique of substractive color imaging in that the pigment particles are each composed of a single component which is both the image colorant and the photosensitive medium.

From about 2 to about 10 percent pigment by weight of imaging particles in the suspension have been found to produce good results. The addition of small amounts (generally ranging from 0.5 to 5 mol. percent) of electron donors or acceptors to the suspensions may impart significant increases in system photosensitivity.

A wide range of voltages may be applied between the electrodes in the system during formation of the image. For good image resolution, high image density and low background it is preferred that the potential applied be such as to create an electric field of at least about 300 volts per mil across the imaging suspension. For example, when the imaging suspension is coated to a thickness of about 1 mil, the electrode spacing will be such that an applied potential of about 300 volts produces a field across the suspension of about 300 volts per mil. Potentials as high as 8,000 volts may be applied to produce images of high quality. As is apparent, the applied potential necessary to obtain the desired field strength will vary depending upon the interelectrode gap as well as the type and thickness of the blocking material utilized.

The invention will now be further described in detail with respect to a specific preferred embodiment thereof by way of an Example, it being understood that this is intended to be illustrative only and the invention is not limited to the materials, percentages, conditions, etc. recited therein. All parts and percentages are by weight unless otherwise specified. The apparatus used is generally similar to that illustrated in FIG. 1 and the electrode webs are advanced at a speed of about 3 ½ inches/-second.

There is provided an injecting electrode according to the invention comprising an approximately 1 mil polypropylene substrate (Bicor B, available from Mobil Chemical Co.) carrying an approximately 5 micron thick polystyrene layer (molecular weight of about 3000) which carries an approximately 3 micron thick conductive layer made up of purified polystyrene sulfonic acid (available from National Starch Co.) having incorporated therein about 5% of Cab-O-Sil. The blocking electrode is an approximately ¾ mil polypropylene sheet. An approximately 30 micron layer of an imaging suspension comprising magenta, cyan and yellow pigment particles in mineral oil is coated on the conductive surface of the injecting electrode. At the imaging zone an electrical field is applied across the imaging suspension by contacting the back of the blocking electrode with a roller held at a potential of −2500 volts D.C. while the conductive surface of the injecting electrode is grounded. The suspension is exposed to a color positive transparency. After imaging has occurred the electrodes are separated and a positive image is formed on the injecting electrode. The injecting electrode is then brought into contact with a paper receiver sheet and the combination is passed through a pair of heated rollers held at a temperature of about 100° C. A pressure of about 20 p.s.i. is applied by the rollers. After transfer and fixing are completed there is found on the paper sheet a good quality image having a clear tack-free overcoating layer.

Although the invention has been described with respect to various preferred embodiments thereof it is not intended to be limited thereto but rather those skilled in the art will recognize that variations and modifications may be made therein which are within the spirit of the invention and the scope of the claims.

What is claimed is:

1. A photoelectrophoretic imaging method comprising the steps of a. providing a layer of an imaging suspension comprising electrically photosensitive pigment particles in an electrically insulating carrier liquid on the surface of a transparent injecting electrode comprising a substrate carrying a thermoplastic polymeric layer which carries a conductive layer;
b. contacting the free surface of said imaging suspension layer with a second electrode;
c. applying an electrical field across said suspension layer;
d. exposing said suspension to an imagewise pattern of activating electromagnetic radiation;
e. separating said electrodes wherein complementary images are formed on the surfaces of said electrodes;
f. heating said injecting electrode sufficiently to soften the thermoplastic polymeric layer;
g. pressure contacting the image bearing surface of said injecting electrode with a receiving member, whereby said image, said conductive layer and at least a portion of the thermoplastic polymeric layer of the injecting electrode are simultaneously transferred to the receiver member, the transferred portion of the polymeric layer forming a protective layer over the image.

2. The method as defined in claim 1 wherein said second electrode is a blocking electrode.

3. The method as defined in claim 2 wherein exposure is made through said injecting electrode.

4. The method as defined in claim 3 wherein said receiver member comprises paper.

5. The method as defined in claim 4 wherein said injecting electrode comprises a polypropylene substrate carrying a polystyrene layer which carries a conductive layer comprising purified polystyrene sulfonic acid and about 5% by weight of colloidal silica.

6. The method as defined in claim 5 wherein said suspension comprises cyan, magenta and yellow colored pigment particles in an electrically insulating carrier liquid.

7. The method as defined in claim 6 wherein steps (f)-(g) are carried out by passing said receiver member and said injecting electrode through at least two heated pressure rollers.

8. The method as defined in claim 7 and further including prior to step (b) the step of corona charging the free surface to cause substantially all of said pigment particles to form a layer on the surface of said injecting electrode.

9. The method as defined in claim 1 wherein exposure is made through said injecting electrode.

10. The method as defined in claim 1 wherein said receiver member comprises paper.

11. The method as defined in claim 1 wherein said injecting electrode comprises a polypropylene substrate carrying a polystyrene layer which carries a conductive layer comprising purified polystyrene sulfinic acid and about 5% by weight of colloidal silica.

12. The method as defined in claim 1 wherein said suspension comprises cyan, magenta and yellow colored particles in an electrically insulating carrier liquid.

13. The method as defined in claim 1 wherein steps (f)-(g) are carried out by passing said receiver member and said injecting electrode through at least two heated pressure rollers.

14. The method as defined in claim 1 and further including prior to step (b) the step of corona charging the free surface of said imaging suspension layer to cause substantially all of said pigment particles to form a layer on the surface of said injecting electrode.

* * * * *